US006318843B1

(12) United States Patent
Feder et al.

(10) Patent No.: US 6,318,843 B1
(45) **Date of Patent: *Nov. 20, 2001**

(54) CONTROL OF ADHESIVE FLOW IN AN INKJET PRINTER PRINTHEAD

(75) Inventors: Melanie J Feder, Blodgett; Victor Selvey; Kirk Haylett, both of Corvallis; Brett Dahlgren, Lebanon, all of OR (US)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/956,635

(22) Filed: Oct. 23, 1997

(51) Int. Cl.[7] ..... B41J 2/14; B41J 2/16; B41J 2/05

(52) U.S. Cl. ..... 347/47; 347/63

(58) Field of Search ..... 347/63, 64, 50, 347/44, 20, 47

(56) References Cited

U.S. PATENT DOCUMENTS

| | | | | |
|---|---|---|---|---|
| 4,917,286 | | 4/1990 | Pollacek | 228/110 |
| 5,442,386 | * | 8/1995 | Childers et al. | 347/63 |
| 5,608,436 | * | 3/1997 | Baughman et al. | 347/65 |
| 5,736,998 | * | 4/1998 | Caren et al. | 347/45 |
| 5,855,713 | * | 1/1999 | Harvey | 156/153 |

FOREIGN PATENT DOCUMENTS

| | | |
|---|---|---|
| 0109755B1 | 10/1983 | (EP) . |
| 0110533A3 | 10/1983 | (EP) . |
| 0154087B1 | 11/1984 | (EP) . |

* cited by examiner

*Primary Examiner*—John Barlow
*Assistant Examiner*—Michael S. Brooke
(74) *Attorney, Agent, or Firm*—Teri G. Andrews

(57) ABSTRACT

An inkjet printer printhead has a layering of a flexible polymer tape, a patterned barrier material that is acting as an adhesive as well as ink channels, and a substrate that has a plurality of ink expulsion devices. Each of the ink propulsion devices is aligned with an orifice hole ablated in the flexible polymer tape where the ink expels and patterns the medium beyond. To keep adhesives and encapsulants required in the assembly of the inkjet printer printhead out of the critical ink channel area near the orifice holes, fluid accumulation channels are ablated into the flexible polymer tape in a strategic location between the adhesive bead and the ink channel. These accumulation channels function as both a diversion a containment point for the excess flow of adhesive.

13 Claims, 4 Drawing Sheets

CONTROL OF ADHESIVE FLOW IN AN INKJET PRINTER PRINTHEAD

BACKGROUND OF THE INVENTION

This invention relates to the control of the flow of an adhesive along a substrate and more particularly to the control of the flow of viscosity varying adhesives required in the manufacture of an inkjet printer printhead.

Inkjet printers operate by expelling a small volume of ink through a plurality of small nozzles or orifices in a flexible polymer tape held in proximity to a medium upon which marks or printing is to be placed. This orificed flexible polymer tape is referred to as oriflex. The orifices are arranged in the oriflex such that the expulsion of a droplet of ink from a determined number of orifices relative to a particular position of the medium results in the production of a portion of a desired character or image. Controlled repositioning of the substrate or the medium and another expulsion of ink droplets continues the production of more pixels of the desired character or image. Inks of selected colors may be coupled to individual arrangements of orifices so that selected firing of the orifices can produce a multicolored image by the inkjet printer.

Each orifice in the oriflex is coupled to an associated small unique ink firing chamber filled with ink and having an individually addressable ink propulsion device, mounted on a substrate, and coupled to the ink. The ink is forced out of the orifice by the ink propulsion device, and deposited on the medium. The displaced volume of ink is replenished from a larger ink reservoir by way of ink feed channels that are patterned into a layer, commonly called barrier, that is interposed between the oriflex and the substrate.

The back surface, that which is opposite the surface facing the media, of the oriflex includes electrically conductive traces which are terminated at the one end by large contact pads designed to interconnect with a printer. The print cartridge is designed to be installed in a printer so that the contact pads on the front surface of the oriflex contact printer electrodes which provide externally generated energization signals to the printhead. To access these traces from the front surface of the oriflex, holes, or vias, must be formed through the front surface of the oriflex to expose the ends of the traces. The exposed ends of the traces are then plated with, for example, gold to form the contact pads on the front surface, that which is facing the media, of the oriflex.

Apertures are excised through the oriflex and are used to facilitate bonding of the second ends of the conductive traces to electrodes on a substrate containing ink propulsion devices. The apertures, after bonding is complete, are filled with a bead of encapsulating adhesive to protect any exposed portion of the traces and substrate. This encapsulating adhesive is referred to as encapsulant. The encapsulant is a liquid system until cross-linking takes place, creating a solid matrix when fully cured. Initially, the encapsulant decreases in its viscosity as it is being cured, further causing it to flow before curing is complete. With no control of the flow of this encapsulant, it is possible for the encapsulant to flow along the substrate, into the ink channel, and ultimately into the ink dispersion orifices. During the low viscosity state of the encapsulant, it is possible for the adhesive to be drawn between the layer of oriflex and the substrate, and into the ink channels formed by the barrier by a capillary force created at the exterior edge of these layers. This phenomenon is commonly referred to as wicking. Wicking takes place at the oriflex to barrier interface with the encapsulant wicking along the oriflex.

Every orifice in an inkjet printer printhead has a function. It is critical that every orifice is free from obstructions in order to eject a droplet of ink. A single orifice which does not fire an ink droplet when it is commanded to do so will leave a portion out of a printed character and will leave an unprinted band on the medium when a solid image is expected. This results in a poorer quality of printed matter, highly undesirable for an inkjet printer.

Other attempts have been made to divert this flow of encapsulant away from the ink dispersion orifices. Experiments have been performed involving heat cycling to control the encapsulant curing process, and adding holes in the oriflex prior to the ink channels to allow the encapsulant to escape prior to reaching the ink dispersion orifices. These experiments have met with minimal success and have, therefore, been unable to consistently control this wicking problem. Prior to the present invention, the wicking was noted as one of the largest contributors to inkjet pen failure. With the invention as described hereinafter, wicking is no longer an issue.

SUMMARY OF THE INVENTION

An inkjet printer printhead utilizes a barrier layer with an ink channel, a first substrate disposed on a first side of the barrier layer, and a second substrate disposed on a second side of the barrier layer opposite the first substrate. A bonding aperture extends through the second substrate and the barrier layer to expose the first substrate without entering the ink channel. An adhesive is disposed on a first side of the second substrate opposite the barrier layer, and engulfing the bonding aperture. At least one fluid accumulation channel is excavated into a second side of the second substrate between the bonding aperture and the ink channel with a portion of the accumulation channel extending over the first substrate thereby reducing the flow of the adhesive from the bonding aperture into the ink channel.

BRIEF DESCRIPTION OF THE DRAWINGS

The present invention can be further understood by reference to the following description and attached drawings which illustrate the preferred embodiment.

DETAILED DESCRIPTION OF THE PREFERRED EMBODIMENT

Figure 1:
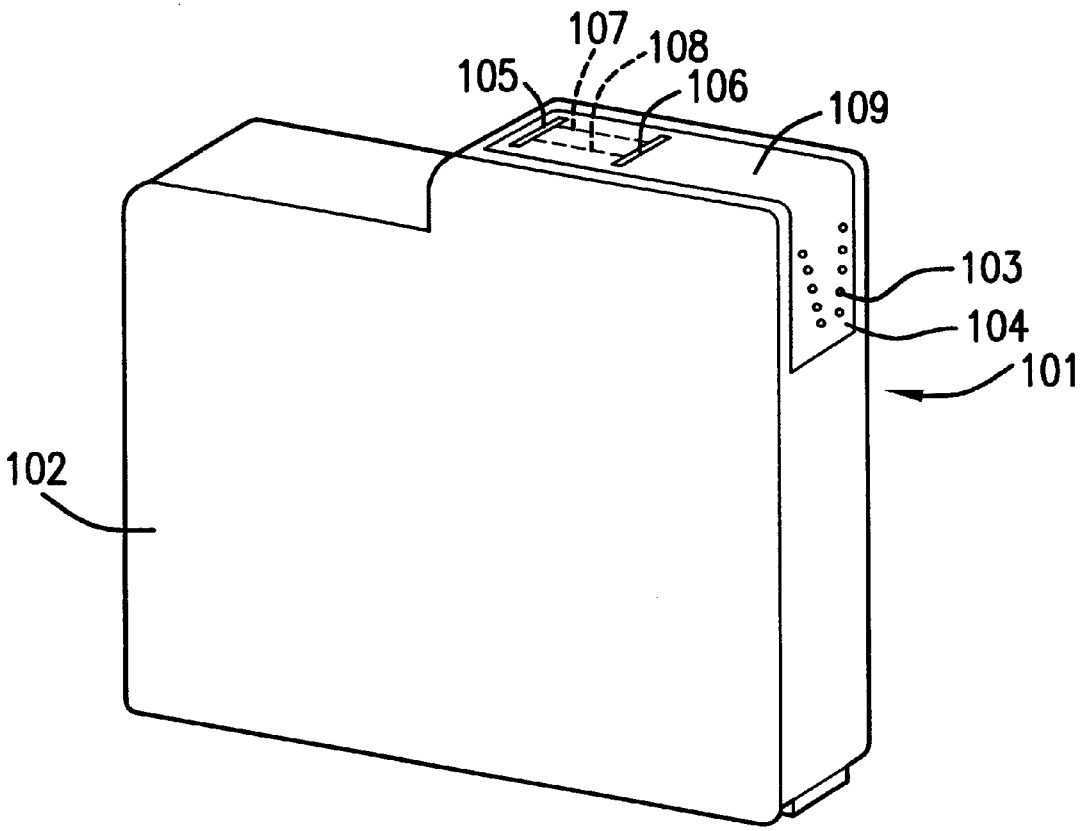
FIG. 1 is a perspective view of an inkjet printer print cartridge according to one embodiment of the present invention.

Referring to FIG. 1, reference number 101 generally indicates an inkjet printer print cartridge incorporating a printhead according to one embodiment of the present invention. The inkjet printer print cartridge 101 includes an ink reservoir 102 and a printhead 109, where the printhead 109 is formed using Tape Automated Bonding (TAB). One conventional technique is described in U.S. Pat. No. 4,917,286 (Pollacek). The printhead 109 (hereinafter "TAB head assembly 109") includes a nozzle member 108 comprising two parallel columns of offset holes or orifices 107 formed in a flexible polymer tape 104 (hereinafter "oriflex 104") by, for example, laser ablation. The oriflex 104 may be purchased commercially as KAPTON tape, available from 3M Corporation. Other suitable tapes may be formed of UPILEX or its equivalent.

A back surface of the oriflex 104 includes conductive traces 207 (shown from the top surface in FIG. 2) formed thereon, for example, using a conventional photolithographic etching and/or plating process. These conductive traces are terminated by large contact pads 103 designed to interconnect with a printer. The print cartridge 101 is designed to be installed in a printer so that the contact pads 103, on the front surface of the oriflex 104, contact printer electrodes providing externally generated energization signals to the TAB head assembly 109.

Figure 2:
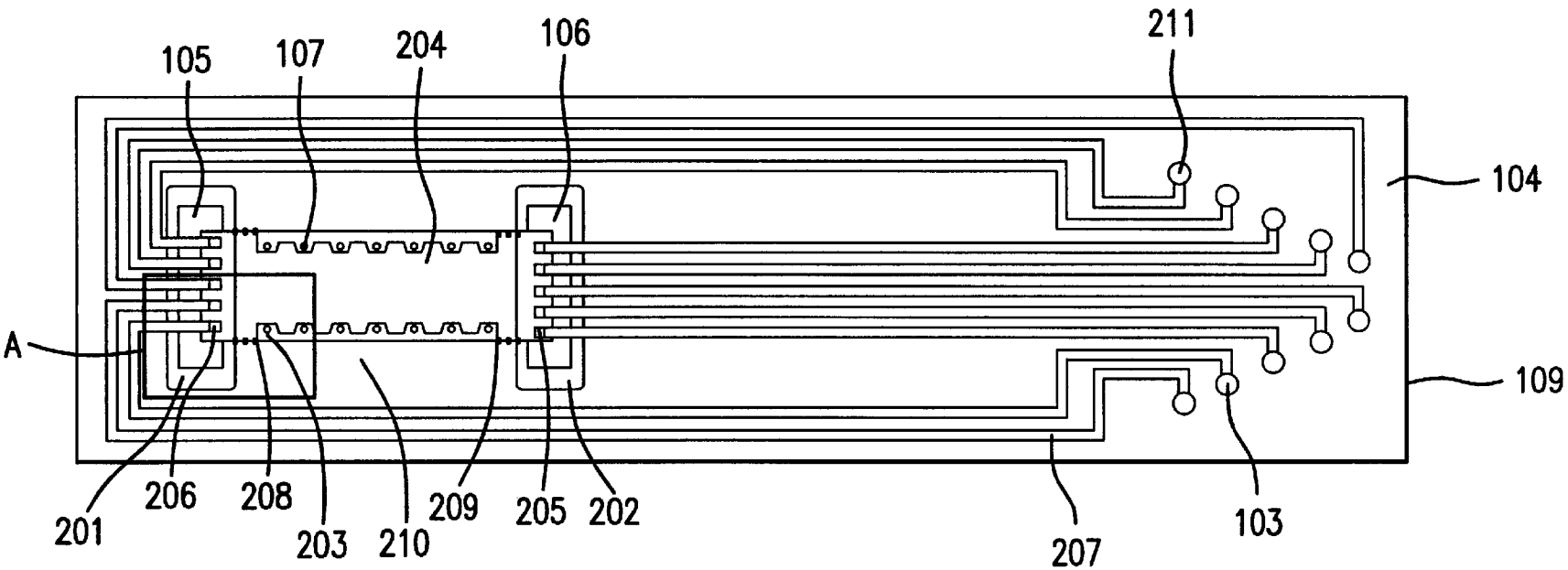
FIG. 2 is a plan view of the top surface of the Tape Automated Bonded (TAB) printhead assembly (hereinafter "TAB head assembly") removed from the print cartridge of FIG. 1.

In the various embodiments shown, the traces are formed on the back surface of the oriflex 104, opposite the surface which faces the recording medium. To access these traces from the front surface of the orifiex 104, holes, or vias are formed through the front surface of the oriflex 104 to expose the exterior trace ends 211 (FIG. 2). The exposed trace ends are then plated with, for example, gold to form the contact pads 103 shown on the front surface of the oriflex 104.

FIG. 2 shows a front view of the TAB head assembly 109 of FIG. 1 removed from the inkjet printer print cartridge 101. Bonding apertures 105 and 106 extend through the oriflex 104 and are used to facilitate bonding of the interior trace ends 205 and 206 of the conductive traces 207 to electrodes 410 (FIG. 4) on the substrate 210. The bonding apertures 105 and 106 are filled with a bead of encapsulating adhesive 201 and 202 (hereinafter "encapsulant bead 201 and 202") to protect any underlying portion of the conductive traces 207 and substrate 210 that otherwise may be exposed through the bonding apertures 105 and 106. It is a feature of the present invention that fluid accumulation channels 208 and 209 are excavated into the oriflex 104.

Affixed to the back of the TAB head assembly 109 is a substrate 210 containing a plurality of individually energizable ink propulsion devices. Each ink propulsion device is located generally behind a single orifice 107 and expels a droplet of ink 407 (FIG. 4) when selectively energized by one or more pulses applied to one or more of the contact pads 103. The ink is supplied from the ink reservoir 102 (FIG. 1) via the ink channel 203 which is defined in the barrier layer 204. In the preferred embodiment, the individually energizable ink propulsion devices are thin film resistors that are contained on a silicon substrate 210. Each resistor acts as an ohmic heater when selectively energized, boils the ink, thereby ejecting the ink through the orifices 107 and onto the medium beyond. The orifices 107 and conductive traces 207 may be of any size, number, and pattern, and the various figures are designed to simply and clearly show the features of the invention. The relative dimensions of the various features have been greatly adjusted for the sake of clarity.

Figure 3:
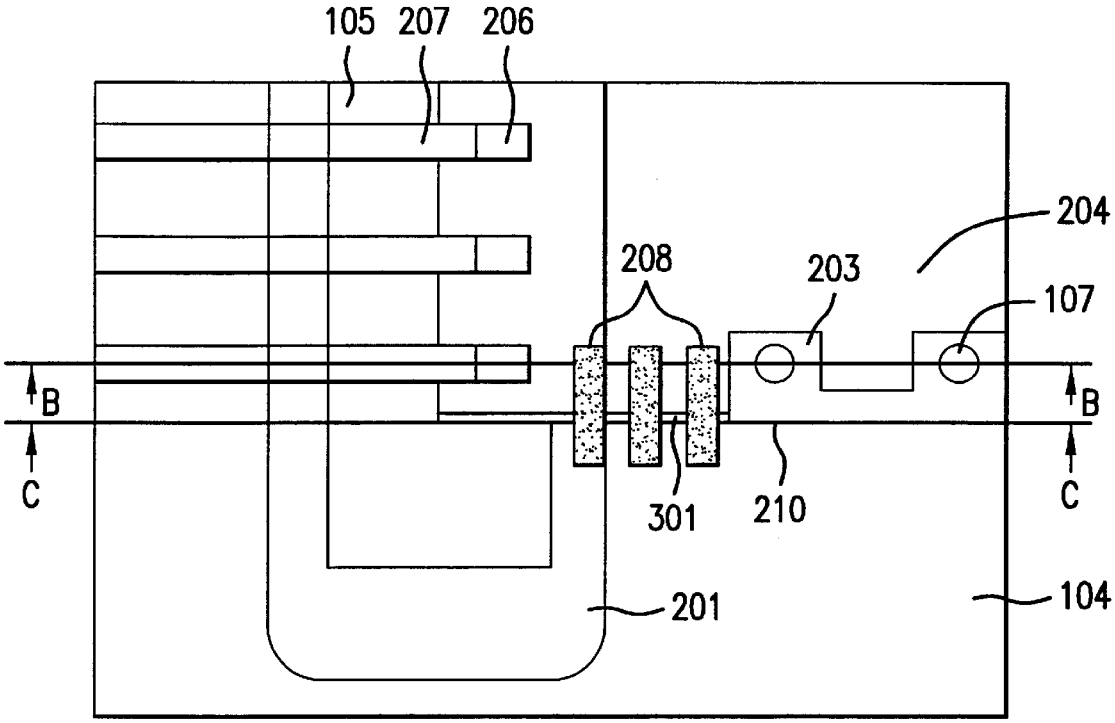
FIG. 3 is view A from FIG. 2, expanded for clarity and a better perspective of the points of cross-sectioning for FIG. 4 and FIG. 5.
Figure 4:
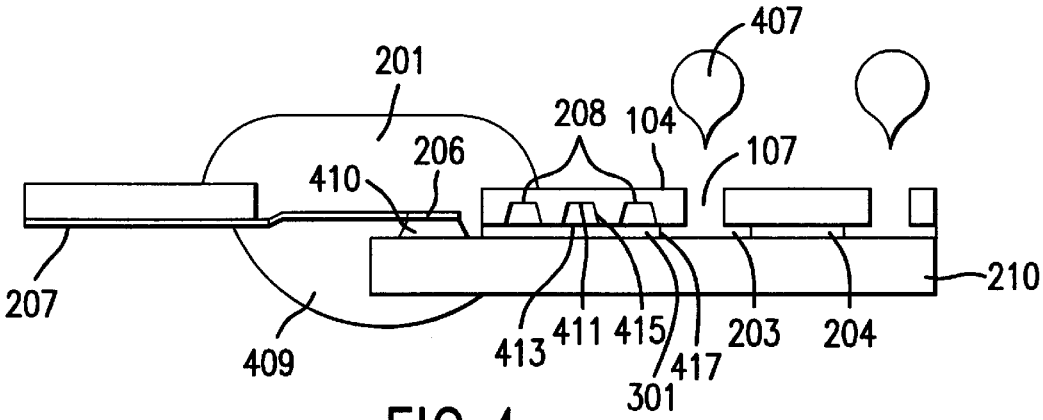
FIG. 4 is a side elevation view in a cross-section taken along line B—B in FIG. 3 illustrating the relationship of the fluid accumulation channels with respect to the layered components of a substrate on a TAB head assembly.

The cross-sectional view at line B—B of FIG. 3 is shown in FIG. 4. This illustrates the substrate 210 mounted to the back of the oriflex 104 and also shows one edge of the patterned barrier layer 204 formed on the substrate 210 containing ink channels 203. The patterned barrier 204 is the center layer between the substrate 210 and the oriflex 104. Shown along the edge 417 of the barrier layer 204 are the entrances of the ink channels 203 which receive ink from the ink reservoir 102 (FIG. 1). The conductive traces 207 formed on the back of the oriflex 104 terminate at the interior trace ends 206 and are bonded to the electrodes 410 located on the substrate 210 on the opposite side of the oriflex 104 from the conductive traces 207. The bonding aperture 105 (FIG. 3) allows access to the ends of the conductive traces 207 and the substrate electrodes 410 (FIG. 4) from the other side of the oriflex 104 to facilitate bonding.

In FIG. 4, showing a preferred embodiment of the present invention, fluid accumulation channels 208 are excavated or laser ablated into the oriflex 104 by a series of 2 microns wide by 140 microns long micro-channels separated by 2 microns wide non-ablated spaces to a width of approximately 55 microns. An alternate embodiment is contemplated where the fluid accumulation channel 208 would be excavated or laser ablated in the oriflex 104 by a series of 2 microns wide by 55 microns long micro-channels separated by 2 microns wide non-ablated spaces to a width of approximately 140 microns. The fluid accumulation channel 208 patterns are included in the laser mask used for the ablation of the orifices 107. The spaces in the mask are necessary to attenuate the laser beam for control of the channel depth and to avoid ablating through the oriflex 104. The ablation in the preferred embodiment is done with an Eximer laser at a wavelength of 248 nanometers, an energy of 350–400 mJ/cm2, and takes approximately 2 seconds to complete. As a result of this method of ablating, the fluid accumulation channels 208 have sloped sides 415. The finished dimensions of the fluid accumulation channels 208 are approximately 25 microns wide and 110 microns long at the channel base 411, and approximately 55 microns wide by 140 microns long at the surface of the oriflex 413. The fluid accumulation channels 208 are spaced between the TAB bond aperture 105 (FIG. 3) and the ink channel 203 (FIG. 3). The preferred embodiment utilizes the fluid accumulation channels 208 in the same orientation as the TAB bond aperture 105 but other orientations such as angular shapes, curved shapes, etc. will perform the same function. Approximately half of the length of the fluid accumulation channels 208 extend beyond the edge of the substrate 210 (FIG. 3). In the present invention, there are three fluid accumulation channels 208 constructed adjacent to each comer of the substrate 210, located at the end of each of the two parallel columns of orifices 107 and 108 (FIG. 1). The number of fluid accumulation channels 208 can be from one to eight and is necessitated by the properties of the adhesive. The fluid accumulation channels 208 can be constructed in a number of sizes, shapes and quantities. The critical criteria for the fluid accumulation channels 208 is that they cross the substrate to barrier mating edge 301.

Also shown in FIG. 4 is a side view of the oriflex 104, the barrier layer 204, fluid accumulation channels 208, the top side bead of encapsulant 201, the under-flow bead of encapsulant 409 which is formed when the encapsulant bead 201 flows through the bonding aperture 105 (FIG. 1) and between the conductive traces 207 prior to cure, and advances toward the ink channels 203. A droplet of ink 407 is shown being ejected from orifice 107 associated with each of the ink channels 203.

The parallel lines created in the channel base 411 of the fluid accumulation channels 208 create a capillary effect, further drawing the encapsulant from beads 201 and under-flow encapsulant bead 409 into the fluid accumulation channels 208, and keeping the encapsulant away from the orifices 107.

Figure 5:
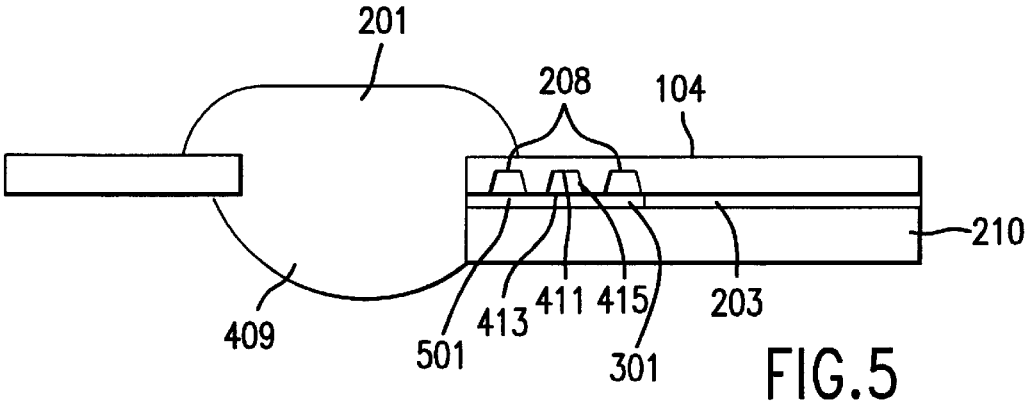
FIG. 5 is a side elevation view in a cross-section taken along line C—C in FIG. 3 illustrating the outermost edge of the substrate and the wicking path of an encapsulant bead originating in a bonding aperture, flowing into the first fluid accumulation channel and wicking toward the ink channel.

The cross-sectional view at line C—C of FIG. 3 is shown in FIG. 5. FIG. 5 cuts through the oriflex 104. This view shows the side edge of the substrate 210, the substrate to barrier mating edge 301, and the entrance to the ink channel 203. FIG. 5 is an illustration of the under-flow encapsulant bead 409 flowing around the comer of substrate 210 at encapsulant edge 501, filling the first fluid accumulation channel 208 and continuing the wicking path toward the next accumulation channel.

The preferred encapsulating adhesive, GRACE, is a liquid system until cross-linking takes place, creating a solid matrix when fully cured. At the onset of the curing process, the encapsulant decreases in viscosity, further causing it to flow before the curing is complete. The amount of flow varies between encapsulants. The more potential flow, the greater number of fluid accumulation channels 208 required to collect the excess uncured encapsulant 501 (FIG. 5) prior to the ink channel 203. The fluid accumulation channel 208 and 209 (FIG. 2) in the preferred embodiment are ablated in all four comers of the oriflex 104 as illustrated in FIG. 2.

Figure 6:
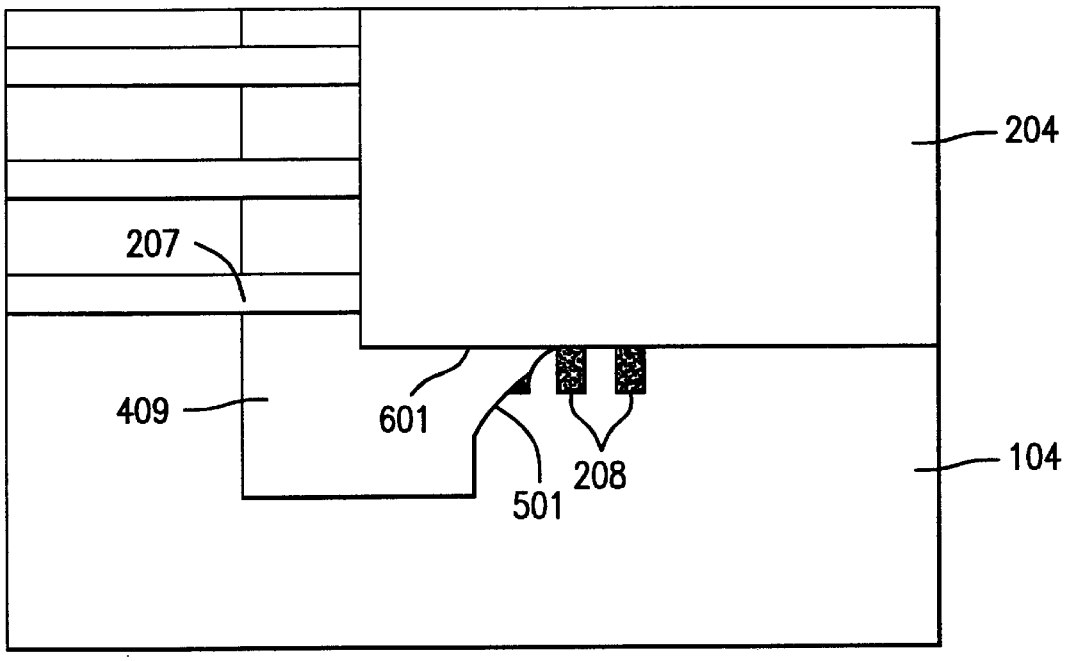
FIG. 6 is a rear view of FIG. 3, illustrating the wicking path of the encapsulant bead with respect to the TAB bond aperture and the fluid accumulation channels along the bottom and exterior edges of the substrate.

FIG. 6 is a bottom view of the TAB head assembly of FIG. 3. It illustrates the flow path 501 of the under-flow encapsulant bead 409. The under-flow encapsulant bead 409 wicks along the substrate edge 601 toward the center of the substrate 204. Without the fluid accumulation channels 208, the under-flow encapsulant bead 409 often flows into the ink channel 203 (FIG. 5), and blocks an orifice 107 (FIG. 4). Each orifice 107 is essential for superior print quality in the inkjet printer print cartridge system.

In the preferred embodiment shown in FIG. 3, the addition of the fluid accumulation channels 208 to divert the encapsulant 201 that wicks along the substrate to barrier mating edge 301 coupled with the extension of the barrier layer 204 at the substrate to barrier mating edge 301 to reduce the capillary effect previously described, the blocking of orifices 107 due to wicking encapsulant 201 has been effectively eliminated.

We claim:

1. An inkjet printer printhead, comprising:

a barrier layer with an ink channel;

a first substrate disposed on a first side of said barrier layer, said first substrate including at least one electrode; and a second substrate disposed on a second side of said barrier layer opposite said first substrate, said second substrate including a front surface and an opposite back surface and at least one conductive trace on the back surface, said second substrate further comprising:

a bonding aperture extending through said second substrate and said barrier layer to expose said first substrate without entering said ink channel, and to expose a portion of said at least one conductive trace and a portion of said at least one electrode;

a single application of encapsulating adhesive applied only from the front surface of said second substrate and only through said bonding aperture, said encapsulating adhesive completely encapsulating only said bonding aperture, said portion of said at least one conductive trace and said portion of said at least one electrode; and at least one fluid accumulation channel excavated into a second side of said second substrate between said bonding aperture and said ink channel with a portion of said at least one fluid accumulation channel extending over said first substrate, said at least one fluid accumulation channel receiving a flow of said encapsulating adhesive in only one direction from said bonding aperture towards said ink channel to substantially minimize said flow of said encapsulating adhesive past said at least one fluid accumulation channel to said ink channel.

2. An inkjet printer printhead in accordance with claim 1 wherein said second substrate further comprises a substrate edge and said barrier layer further comprises a substrate to barrier mating edge, said substrate to barrier mating edge disposed between said bonding aperture and said ink channel and extending to said substrate edge.

3. An inkjet printer printhead in accordance with claim 1 wherein said at least one fluid accumulation channel is excavated with a laser into said second substrate.

4. An inkjet printer printhead in accordance with claim 1 wherein said at least one fluid accumulation channel is mechanically carved into said second substrate.

5. An inkjet printer printhead in accordance with claim 1 wherein said at least one fluid accumulation channel is chemically etched into said second substrate.

6. An inkjet printer printhead in accordance with claim 2 wherein said at least one fluid accumulation channel crosses said substrate to barrier mating edge of said barrier layer.

7. A method of manufacturing an inkjet printer printhead comprising the steps of:

excising a bonding aperture through a first substrate that includes a front surface and an opposite back surface and at least one conductive trace on the back surface;

excavating at least one fluid accumulation channel in a first side of said first substrate disposed apart from said bonding aperture;

patterning a barrier layer with an ink channel;

layering onto said first side of said first substrate said barrier layer such that said at least one fluid accumulation channel is disposed between said ink channel and said bonding aperture;

layering a second substrate, that includes at least one electrode, onto an opposite side of said barrier layer from said first substrate, said bonding aperture exposing a portion of said at least one conductive trace and a portion of said at least one electrode; and disposing a single application of encapsulating adhesive only on the front surface of said first substrate and only through said bonding aperture for completely encapsulating only said bonding aperture, said portion of said at least one conductive trace and said portion of said at least one electrode, said at least one fluid accumulation channel receiving a flow of said encapsulating adhesive in only one direction from said bonding aperture towards said ink channel to substantially minimize said flow of said encapsulating adhesive past said at least one fluid accumulation channel to said ink channel.

8. A method of manufacturing an inkjet printer printhead in accordance with claim 7 further comprising the step of excavating said at least one fluid accumulation channel having a portion of said at least one fluid accumulation channel extending over said second substrate.

9. A method of manufacturing an inkjet printer printhead in accordance with claim 7 further comprising the step of excavating said at least one fluid accumulation channel into said first substrate to a depth of less than 80 percent of a total depth of said first substrate.

10. A method of manufacturing an inkjet printer printhead in accordance with claim 7 further comprising the step of excavating said at least one fluid accumulation channel with a width of 25 to 55 microns and a length of 110 to 140 microns.

11. A method of manufacturing an inkjet printer printhead in accordance with claim 7 further comprising the step of excavating said at least one fluid accumulation channel is excavated by a laser.

12. A method of manufacturing an inkjet printer printhead in accordance with claim 7 further comprising the step of excavating said at least one fluid accumulation channel is excavated by a chemical etch process.

13. A method of manufacturing an inkjet printhead in accordance with claim 7 further comprising the step of curing said encapsulating adhesive.

* * * * *

UNITED STATES PATENT AND TRADEMARK OFFICE

CERTIFICATE OF CORRECTION

PATENT NO. : 6,318,843 B1
DATED : November 20, 2001
INVENTOR(S) : Feder et al.

It is certified that error appears in the above-identified patent and that said Letters Patent is hereby corrected as shown below:

Column 7,
Line 11, “disposing” should read -- applying --;
Line 12, “on” should read -- from --.

Signed and Sealed this

Twenty-fifth Day of February, 2003

JAMES E. ROGAN
*Director of the United States Patent and Trademark Office*